United States Patent [19]

Finizza

[11] 4,309,028

[45] Jan. 5, 1982

[54] STRIKING DEVICE

[76] Inventor: Theodore Finizza, 4825 N. Sedgewick, Lyndhurst, Ohio 44124

[21] Appl. No.: 949,816

[22] Filed: Oct. 10, 1978

[51] Int. Cl.[3] ..... A63B 69/00

[52] U.S. Cl. ..... 272/76; 273/67 R; 248/251

[58] Field of Search ..... 272/76, 77, 78, 79 D, 272/67, 68, DIG. 4, DIG. 5; 233/55 R, 184 B, 185 D, 29 A, 26 E, 181 R, 197 R, 197 A, 198; 273/76, 77; 46/47

[56] References Cited

U.S. PATENT DOCUMENTS

| | | | |
|---|---|---|---|
| 1,890,696 | 12/1932 | Rosenhahn | 273/78 |
| 2,812,683 | 11/1957 | Harold et al. | 46/47 |
| 2,920,418 | 1/1960 | Britt | 46/47 |
| 3,118,671 | 1/1964 | Smith | 273/26 E |
| 3,472,075 | 10/1969 | Oppenheimer | 273/185 D |
| 3,552,749 | 1/1971 | Piggotte | 273/55 R |
| 3,588,104 | 6/1971 | Griffin | 273/26 E |
| 3,896,583 | 7/1975 | Baettcher | 46/47 |
| 3,962,949 | 6/1976 | Trowbridge | 46/47 |
| 4,170,352 | 10/1979 | Vcala | 273/29 A |

FOREIGN PATENT DOCUMENTS

| | | | |
|---|---|---|---|
| 702044 | 1/1941 | Fed. Rep. of Germany | 273/78 |
| 787434 | 3/1935 | France | 273/78 |

*Primary Examiner*—Richard C. Pinkham
*Assistant Examiner*—T. Brown
*Attorney, Agent, or Firm*—Maky, Renner, Otto & Boisselle

[57] ABSTRACT

A balanced dumbell-shape striking type exercise device is mounted for adjustable balanced rotation about a support. Adjustment of rotatability is provided by a pair of springs on the support to apply rotation resisting force to the dumbell; by changing compression of the springs resistance to rotation is correspondingly varied. Handles on the support enable the exercise device to be hand-held or the support may be attached to a mounting bracket which holds one or more such exercise devices.

17 Claims, 5 Drawing Figures

STRIKING DEVICE

TECHNICAL FIELD

The present invention relates to a striking type exercise device and more particularly to an exercise device used for training students of the martial arts, such as karate and judo.

BACKGROUND OF PRIOR ART

To facilitate muscle development and to sharpen reflex times, students of the martial arts often find it desirable to engage in certain exercises. Various types of exercisors have been proposed before; however, they have been bulky and cumbersome, requiring a large area to be dedicated to their use. In addition, many prior devices are designed for hand striking only and further are non-adjustable in accordance with the skills of beginning through advanced students.

One prior exercisor device is shown in U.S. Pat. No. 3,724,845. Such device may be hand-held or mounted on a large stand. The exerciser includes a pendulum that is struck and thereby caused to rotate in an unbalanced manner about a support rod.

SUMMARY OF THE INVENTION

The present invention provides a striking type exercise device which may be hand-held or mounted on an improved bracket, fixed, for example, to a wall or door. The invention includes at least one dumbbell-like device, hereinafter dumbbell, which has large padded ends connected by a shaft, and a support, such as a rigid rod, on which the dumbbell is rotatably mounted in a substantially balanced manner. Rotatability, i.e., resistance to rotation, is adjustable to compensate for the relative experience of a user. Such adjustability is accomplished by changing the compression of one or more springs positioned about the rod to exert pressure on the dumbbell shaft. Consequently, the force required to rotate the dumbbell about the rod will be directly proportional to the spring compression whereas the speed of such rotation will be inversely proportional to such compression. Usually two such springs are used so that they also provide a centering function for the dumbbell on the rod.

According to one aspect of the invention, the exercise device has threaded handles, which are threaded onto corresponding threads of the rod. The handles facilitate holding by the exercisor or by another person, and the threaded connection thereof minimizes risk of the handles slipping from the rod. Moreover, the threaded position of the handles on the rod may be adjusted to vary the compression of the rotation resisting and centering springs, and a lock nut arrangement prevents rotation of the handles with respect to the rod.

According to another aspect of the invention, an improved mounting bracket facilitates securely mounting one or more exercise devices on a wall or door.

The ends of the dumbbell may be of different contrasting colors to facilitate visual discernment. Additionally, a dumbbell shape bat-like device, which also can be color coded like the dumbbell, may be used to strike the latter.

With the foregoing in mind, it is a primary object of the present invention to facilitate development of muscles, reflex times, and coordination, especially by use of a striking type exercise device that is improved in the noted respect.

Another object is to provide facile adjustment of rotatability of a dumbbell exercise device.

Additional objects include providing a secure handle attaching and locking mechanism as well as a dumbbell centering mechanism for a striking type exercise device.

A further object is to provide an improved mounting mechanism for one or more striking type dumbbell exercise devices.

Still other objects are to provide color contrast between opposite ends of a striking type dumbbell exercise device.

DESCRIPTION OF THE PREFERRED EMBODIMENT

Figure 1:
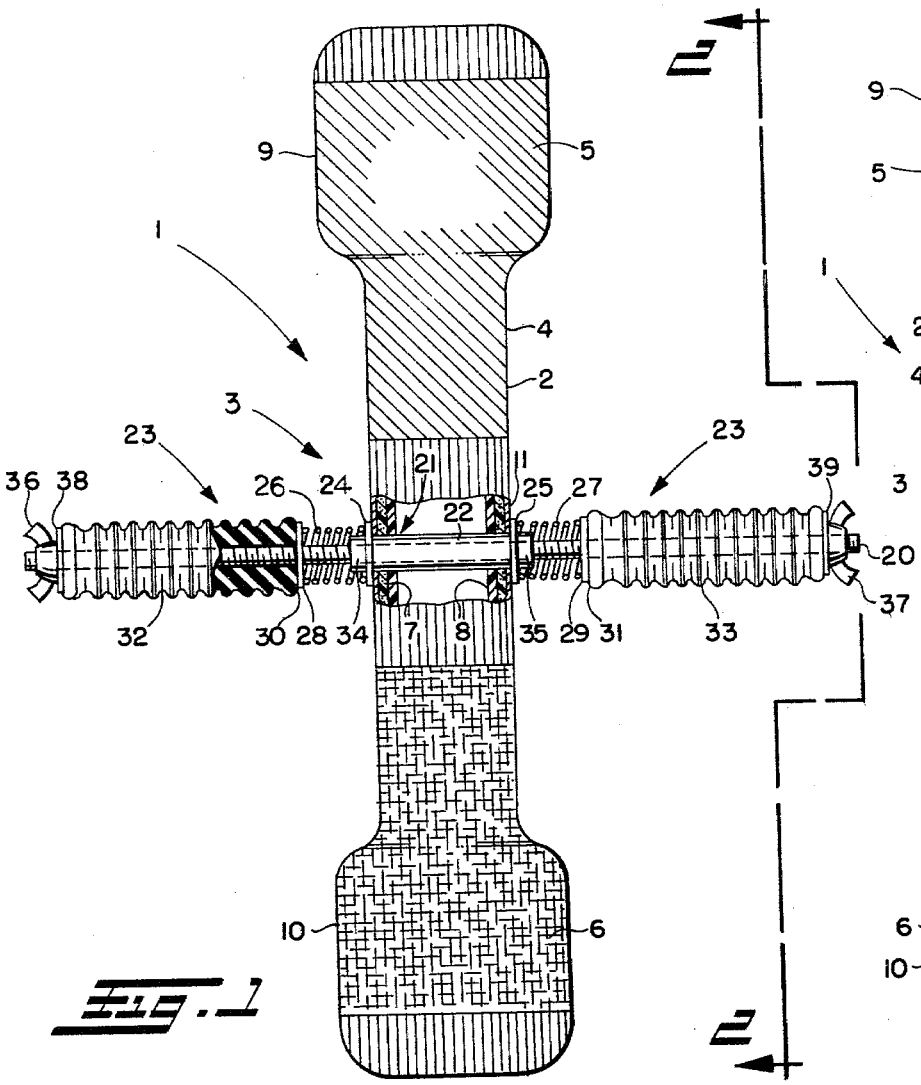
FIG. 1 is a front view, partially broken away in section, of a portable hand-held exercise device in accordance with the invention.
Figure 2:
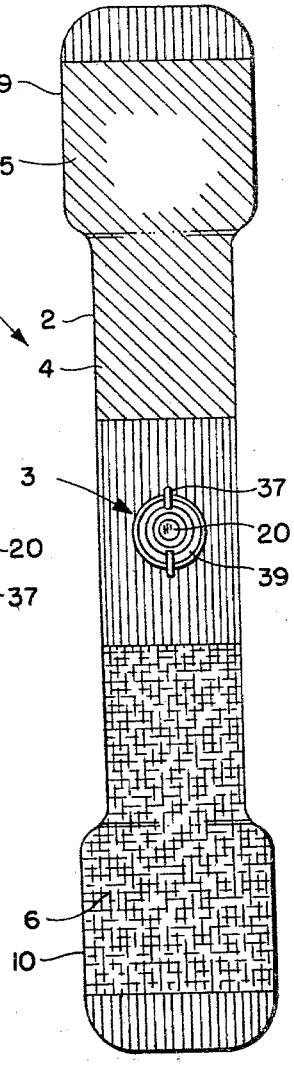
FIG. 2 is a side view of the exercise device looking in the direction of the arrows 2—2 of FIG. 1.

Referring now in detail to the drawings, wherein like reference numerals designate like parts in the several figures, and initially to FIGS. 1 and 2, a striking type exercise in accordance with the present invention is generally indicated at 1. The fundamental components of the exercise device 1 include a dumbbell 2, which is a target intended to be struck by a user or exercisor, and a support structure 3 on which the dumbbell target is rotatability supported for balanced rotation after being so struck.

The dumbbell 2 is generally of well known dumbbell shape having an elongate shaft 4 and a pair of enlarged ends 5, 6. The shaft 4 includes, for example, a hollow plastic cylinder 7 covered by a layer of cushion material 8, such as rubber, foam, or the like, preferably to protect the hands of a person using the exercise device 1 and to dissipate energy upon being struck to protect the cylinder 7 from damage. The front and back faces of the ends 5, 6 are enlarged in apparent cross-section relative to that of the shaft 4 to provide adequate targets intended to be struck, for example, by the hand of a user of the exercise device 1. The ends 5, 6 may be formed by an underlying rigid support structure coupled directly to the shaft 4 with a covering of cushion material 9, 10 thereover. The cushion material over the ends 5, 6 preferably is thicker or, at least, has a greater cushioning effect than that covering the cylinder 7. Such cushion material on the ends 5, 6 absorbs each blow as the end is struck by a user to avoid injury to the user's hands or foot; additionally, such cushion material preferably is fairly resilient to provide a rebound effect when struck by a user, as opposed, for example, to a blow deadening, energy absorbing effect, thereby helping to assure that upon being struck properly the dumbbell 2 will rotate about the support structure 3. Moreover, the weight of the enlarged ends 5, 6 helps to maintain the rotational momentum of the dumbbell 2 after it has been struck while the relatively smaller cross sectional size shaft 4 helps to minimize the weight of the exercise device 1.

According to the best mode of the invention, the shaft 4 and ends 5, 6 of the dumbbell 2 are wrapped with tape or a tape-like material of a plasticized fabric base or synthetic material base. Such tape has a pressure responsive adhesive material on one side that adheres well to the cushion material of the dumbbell 2. The tape protects the cushion material to avoid damage thereto and can be easily replaced or covered by an extra strip of tape, when necessary, for repair purposes.

Preferably the dumbbell 2 is color coded to facilitate visual discernment of the opposite ends during use and to add to the variety of ways in which the exercise device 1 may be used. According to the best mode of the invention, various portions of the dumbbell 2 are color coded in contrasting colors, as follows: a major portion of the end 5, including a proximate portion of the shaft 4, is green; a major portion of the end 6, including a proximate portion of the shaft 4, is yellow; the shaft 4 on opposite sides of the mounting structure 3 is red; and the edges or tips of the ends 5, 6 are red. The color-coding can be effected in a fascile manner by using tape 11 of different colors to cover the respective portions of the dumbbell 2; additionally, a further layer of tape 11 of a different color may be applied, as desired, to change the color-coding. It should be understood that color-coding may be accomplished using other color selections, although those colors just described have been found to provide particularly good contrast to facilitate visual discernment of the respective ends 5, 6 during rotation of the dumbbell 2.

The support structure 3 provides both a secure support about which the dumbbell 2 may rotate in a relatively fluidic balanced manner and part of a convenient rotatability adjustment. The support structure 3 includes a rigid rod 20, for example of metal, which passes through an opening 21 in the dumbbell assembly 2. The opening 21 is approximately half-way between the opposite ends thereof, is approximately perpendicular to the major axial extent of the dumbbell, and is in a plane approximately parallel to those in which the respective front and back faces of the ends 5, 6 are primarily located. Accordingly, the dumbbell 2 is relatively balanced about the rod 20. A plastic sleeve 22 inserted into relatively tight engagement with the walls of the opening 21 provides a bearing for the rod 20 and dumbbell 2 facilitating rotation of the latter about the former while minimizing wear, for example, of the cylinder 7 at the opening 21.

The rotatability adjustment mechanism 23 includes a pair of frictional bearing members, such as metal washers 24, 25, in abutment with the dumbbell shaft 4 to apply thereto a normal force and a force resisting or opposing rotation thereof; a pair of springs 26, 27, which urge the respective washers 24, 25 against the shaft 4; and a pair of thrust surfaces, in the preferred embodiment a further pair of washers 28, 29, and end faces 30, 31 of handles 32, 33, which compress the springs against the washers 24, 25. The washers 24, 25 have static and sliding coefficients of friction with respect to the shaft 4 and with respect to the springs 26, 27. Similarly, the washers 28, 29 have static and sliding coefficients of friction with respect to the springs 26, 27 and with respect to the handle and faces 30, 31. The compression and, thus, the force of the springs and the forces with which the parts of the rotatability adjustment mechanism 23 bear against each other and against the shaft 4 can be changed; and resistance to rotation of the dumbbell 2 about the support structure 3, i.e. rotatability, can be accordingly adjusted. The amount of force with which the user or exercisor must strike one of the ends 5, 6 to rotate the dumbbell 2 about the supporting structure 3 and both the speed of such rotation and the deceleration of the dumbbell may be adjusted, then, as aforesaid.

In accordance with the preferred embodiment of the invention, the washers 24, 25 are conventional metal washers that fit over ends 34, 35 of the sleeve 22, which protrude beyond or outside the shaft 4, for alignment in circumscribing relation about the rod 20. Moreover, in accordance with the best mode of the invention, as the dumbbell 2 rotates, the washers 24, 25, springs 26, 27, and washers 28, 29 rotate with the dumbbell 2 while the washers 28, 29 slide over the handle end faces 30, 31 to resist dumbbell rotation. The washers 28, 29, then, minimize wear of the handle end faces 30, 31.

The exercise device 1 illustrated in FIGS. 1 and 2 may be held manually by a user or by an assistant. The handles 32, 33 facilitate holding the device 1 and apply thrust force to the washers 28, 29 of the rotation adjustment mechanism 23. The handles 32, 33 are secured to the rod by female threads in the interior handle passage, for example as shown at 34, that mate with a corresponding male thread on the rod 20. By tightening or loosening one or both handles on the rod 20 toward or away from the shaft 4, compression of the respective springs 26, 27 can be changed to adjust rotatability of the dumbbell 2. Preferably the springs 26, 27 are approximately of the same size and force constants; therefore, the springs will tend to center the dumbbell 2 on the rod 20 approximately equidistant between the handles 32, 33.

A handle locking mechanism is provided to lock the respective handles 32, 33 in respective fixed positions on the rod 20 during use of the exercise device 1. Such locking mechanism includes a pair of wing nuts 36, 37, which are threaded onto the rod 20, force distributing washers 38, 39, which are positioned between the respective wing nuts and handles, as shown, and the threaded interior passages 34 of the handles which resist movement of the handles on the rod. By turning the wing nuts 36, 37 such that they bear against the washers 38, 39 forcing the latter into tight engagement with the outer faces of the handles 32, 33, the handles will remain in relatively fixed locations on the rod 20. Moreover, the force applied to the threads of the rod 20 by the cooperative pairs of handles with their respective wing nuts will tend to prevent rotation of the rod with respect to the handles as the dumbbell 2 rotates about the rod.

To use the exercise device 1, a person would adjust the rotatability adjustment mechanism 23 for a desired rotatability by tightening or loosening one or both of the handles 32, 33. The wing nuts 36, 37 are tightened, then, to lock the handles on the rod. The user may hold one handle with one hand and with the other hand or a portion thereof may strike one face of one of the target ends 5 or 6 causing the dumbbell 2 to rotate about the support structure 3. Subsequently, the same or opposite face of such target end or the same or opposite face of the opposite target end may be struck in any desired sequence, depending on the particular exercise. Alternatively, both handles 32, 33 may be held by one person while another person uses one or both hands, arms, and/or feet, etc., to strike respective faces of the target ends 5, 6.

Figure 3:
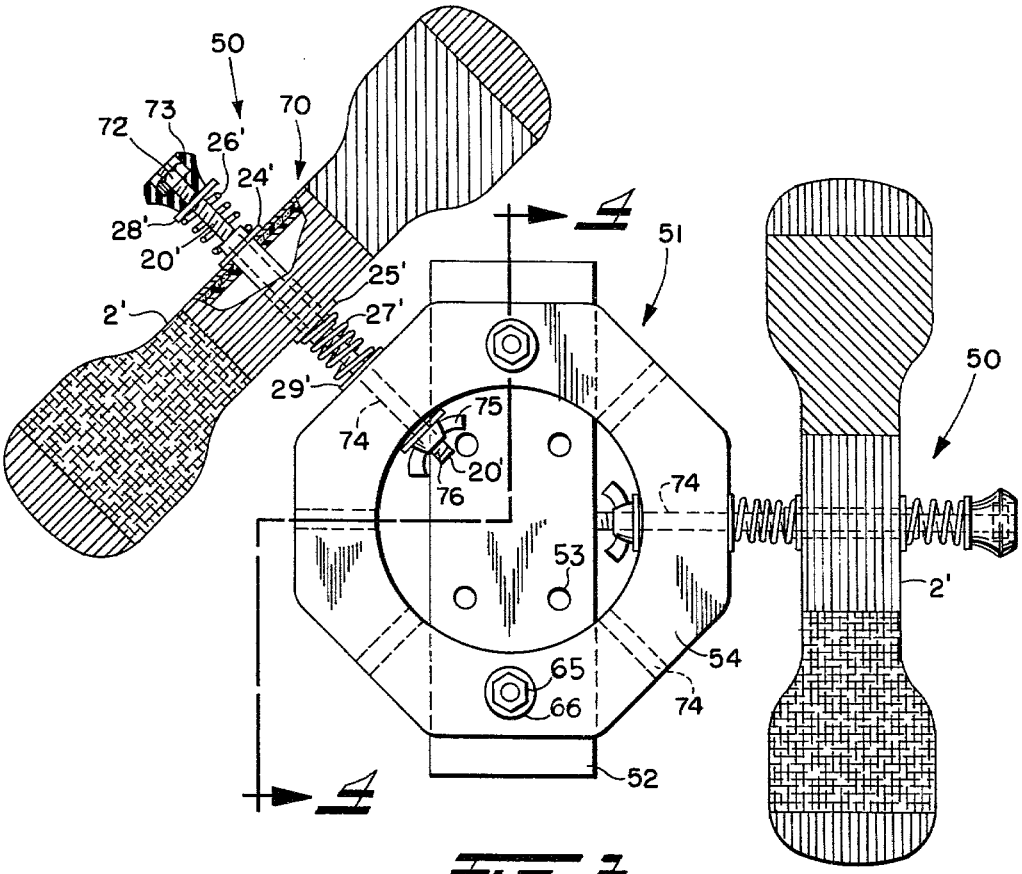
FIG. 3 is a front view, partially broken away in section, of a mounted exercise device in accordance with another embodiment of the invention.
Figure 4:
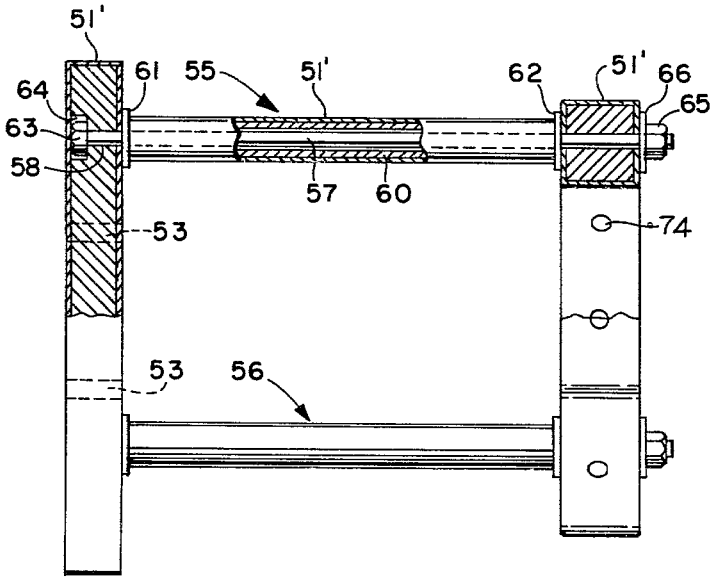
FIG. 4 is a side view of the mounting bracket of FIG. 3 looking generally in the direction of arrows 4—4.

Turning now to FIGS. 3 and 4, a modified striking type exercise device 50, which is intended to be mounted on a fixed bracket, and a mounting bracket 51 therefor are illustrated. The bracket 51 may accomodate more than one exercise device 50 thereby allowing a person to exercise with both hands, etc., simultaneously with complex exercises without requiring the services of another individual to hold the exercise device 2'. For exemplary purposes the bracket 51 is illustrated in FIG. 3 with two such exercise devices thereon, and for simplicity of illustration in FIG. 4 the exercise devices are not shown mounted on the bracket 51.

The mounting bracket 51 includes a rectangular wall mount 52, such as a metal or wood plate, with plural holes 53 through which screw or like fasteners may pass for attaching the mount to a planer service, such as a wall or door. The mounting bracket 51 also includes a mounting ring 54 that is securely held in spaced apart relation to the mount 52 by securing members 55, 56, which preferably are identical. The securing member 55, for example, includes a long bolt 57 which passes through an opening 58 in the mount 52 and through an opening 59 in the mounting ring 54. A metal or plastic sleeve 60 surrounds the major linear extent of the bolt 57 to space the ring 54 away from the mount 52. Force distributing washers 61, 62 at opposite ends of the sleeve 60 abut the respective mount and ring. The head 63 of the bolt 57 is positioned in a counter sunk recess 64 of the mount 52, and a nut 65 threaded onto the bolt 57 may be tightened against a washer 66 to secure the mount 52 and ring 54 in tight engagement with the sleeve 60 via the washers 61, 62. It will be appreciated that alternative securing members may be employed to secure the mounting ring 54 in the desired spaced apart relation to the mount 52. For example, in place of each of the securing members 55, 56, an elongate stud-like member may be welded to the mount 52 and ring 54 approximately at the locations the washers 61, 62, etc., respectively abut the same.

Preferably the mounting ring 54 is octagonal, although rectangular, circular, and other shapes may be employed. An advantage to the octagonal shape is the facility with which a user may mount one or more exercise devices 50 for rotation of the respective dumbbell 2' of each in easily discernible vertical, horizontal, and/or diagonal, i.e. relative to the horizontal or vertical, planes.

The exercise device 50 is generally similar to the exercise device 1 described above with reference to FIGS. 1 and 2. Accordingly, primed reference numerals are used in FIG. 3 to designate parts of the exercise device 50 that correspond with those designated by the same unprimed reference numerals in FIGS. 1 and 2.

The exercise device 50 is different from the exercise device 1 in the modified support structure 70. Such support structure 70 includes a rotatability adjustment mechanism 70' with washers 24', 25', springs 26', 27', and thrust washers 28', 29', together with a modified thrust producing mechanism for the thrust washers. In particular, the rod 20' has a nut 72 threaded at one end thereof. The nut 72 abuts a rubber, or other cushion type material, stopper-like device 73, which applies thrust to the thrust washer 28'. Although the nut 72 may be directly engaged with the thrust washer 28', preferably the nut 72 is located in a counter-sunk recess of the stopper-like device 73, which provides a protective covering over the nut to minimize injury to a user. The stopper-like device 73 may be threaded onto one end of the rod 20' to form a lock nut arrangement with the nut 72 to prevent slippage of the nut on the rod. Alternatively, the nut 72 may be otherwise securely fastened to the rod 20', for example, by peening, soldering, welding, or the like; or the rod 20' may be a bolt having a head that is substituted for the nut 72.

The opposite end of the threaded rod 20' from the nut 72 is threaded into a correspondingly threaded opening 74 in the mounting ring 54. A wing nut 75 is threaded onto the remote end 76 of the rod 20' and is tightening against the force distributing washer 77, which abuts the mounting ring 54 to provide with the cooperative engagement of the threads of the rod 20' and opening 74 a locking mechanism to prevent rotation and loosening of the rod 20' relative to the mounting ring as the dumbbell assembly rotates about the rod.

Rotatability of the exercise device 2' may be adjusted by tightening or loosening the rod 20' in the threaded opening 74 of the mounting ring 54 to adjust compression of the springs 26', 27'. With the mounting bracket 51 accordingly mounted on a door or wall and one or more exercise devices 2' secured to the mounting ring 54, such exercise device or a plurality of such exercise devices, may be struck by one or both hands, arms, or feet of a user, as desired, to practice coordination, to increase muscle strength and tone, to reduce reflex time, etc. For protection of the hands, etc., of a person during such use, the wall mount 52 and mounting ring 54 as well as the securing members 55, 56 may be covered with one or more layers of tape and/or cushion material 78.

Figure 5:
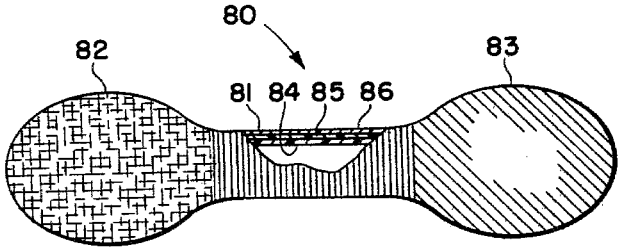
FIG. 5 is a perspective view of a hand bat for hitting a dumbbell of an exercise device.

Referring briefly to FIG. 5, a hand-held bat 80 of dumbbell shape may be used for striking the dumbbell assemblies 2, 2' described above. The bat 80 also is of dumbbell shape having a centrally elongate shaft 81 and a pair of enlarged bulbous ends 82, 83 that preferably are padded to avoid injury to a user and/or damage to the respective target ends 5, 6 of the dumbbell assembly 2, for example. The shaft 81 also preferably is like the shaft 4 above, including a rigid hollow cylinder 84 to minimize weight, and cushion material 85 and tape 86 to facilitate grasping and repair, respectively. Moreover, the ends 82, 83 of the back 80 may be color coded with colors similar to those of the respective target ends 5, 6, say green and yellow, respectively, of the exercise device 1, the green end of the bat may be used only to strike the green target end of the dumbbell assembly 2 and the yellow end of the bat used to strike the yellow target end of the dumbbell assembly; the colors facilitate visual discernment, as described above, and exercising using both colors, as described, helps to develop wrist action.

From the foregoing it will be clear that the several embodiments of the striking type exercise device in accordance with the present invention are relatively uncomplicated and compact while also being rugged and extremely useful by a student of the martial arts to perform exercising that strengthen muscles, sharpen reflexes, etc. The space required for the invention and for use of the same is minimized as is the risk of injury to a person using the same.

I claim:

1. A portable manually supportable striking type exercise device comprising balanced elongate target means for receiving blows, support means for supporting said target means for substantially balanced rotation about said support means, said support means including manually graspable means for facilitating manual grasping of said support means and manual holding of the striking device while said target means is struck by a part of the body of a person, and adjusting means for adjusting the rotatability of said target means about said support means, said target means comprising an elongate shaft-like member and respective target ends at opposite ends of said shaft like member, and said adjusting means comprising means for applying to said shaft-like member a force resisting such rotation of said target means.

2. The device of claim 1 wherein said target means further comprising a dumbbell shape device, the cross section of said target ends being larger than that of said shaft-like member.

3. The device of claim 2, further comprising cushion material covering said target ends.

4. The device of claim 3, said cushion material being resilient to rebound upon being struck, and further comprising cushion material on at least a substantial portion of said shaft-like member.

5. The device of claim 2, said target ends being of different respective contrasting colors, and at least a substantial portion of said shaft-like member being of a third contrasting color with respect those of said target ends.

6. The device of claim 2, wherein said target ends are of different contrasting colors to facilitate visual discernment thereof during rotation about said support means.

7. The device of claim 1, said means for adjusting comprising washer-like means positioned about said support means for applying a normal force to said target means and resilient means for applying a normal force to said washer-like means urging the same toward said target means.

8. The device of claim 7, said resilient means comprising coiled springs positioned about said support means.

9. The device of claim 7, further comprising thrust means for adjustably compressing and releasing said resilient means in relation to said washer-like means.

10. The device of claim 9, said thrust means comprising handles mounted on said support means.

11. A striking type exercise device comprising balanced elongate target means for receiving blows, support means for supporting said target means for substantially balanced rotation about said support means, said target means comprising a dumbbell shape device including an elongate shaft and respective target ends at opposite ends of said shaft, the cross section of said target ends being larger than that of said shaft, cushion material covering said target ends, said cushion material being resilient to rebound upon being struck, cushion material on at least a substantial portion of said shaft, and tape means for covering at least a substantial portion of said target ends and said shaft.

12. A striking type exercise device comprising balanced elongate target means for receiving blows, support means for supporting said target means for substantially balanced rotation about said support means, adjusting means for adjusting the rotatability of said target means about said support means, said adjusting means comprising washer-like means positioned about said support means for applying a normal force to said target means and resilient means for urging said washer-like means into abutment with said target means, said support means comprising a rigid support and a sleeve-like bearing through said target means for mounting the latter on said support, a portion of said bearing means extending beyond said target means on each side thereof, and said washer-like means being positioned in circumscribing relation on said portions of said bearing.

13. A striking type exercise device comprising balanced elongate target means for receiving blows, support means for supporting said target means for substantially balanced rotation about said support means, adjusting means for adjusting the rotatability of said target means about said support means, said adjusting means comprising washer-like means positioned about said support means for applying normal force to said target means and coiled spring resilient means positioned about said support means for urging said washer-like means into abutment with said target means, and thrust means for adjustably compressing and releasing said resilient means in relation to said washer-like means, said thrust means comprising handles mounted on said support means, said support means comprising a rigid rod-like support having threaded end portions, each of said handles having a threaded passage therein in cooperative threaded engagement with said rod-like support.

14. The device of claim 13, further comprising lock means for locking said handles onto said rod-like support to prevent relative rotation thereof, said lock means including a respective lock nut threaded onto said rod-like support in abutment and locking engagement with each handle.

15. The device of claim 13, resilient means comprising coiled springs positioned about said rod-like support and further comprising washer-like spacers positioned between and in abutment with respective springs and handles.

16. A striking type exercise device comprising balanced elongate target means for receiving blows, support means for supporting said target means for substantially balanced rotation about said support means, said support means comprising a rod-like support having threaded end portions, further comprising handles mounted on said rod-like support, said handles having threaded passages therein for mounting engagement with said threaded end portions of said rod-like support, and further comprising locking means for locking said handles on said rod-like support to prevent relative rotation thereof.

17. The device of claim 16, said lock means comprising a respective lock nut threaded onto said rod-like support in abutment and locking engagement with each handle.

* * * * *